US006351622B1

(12) United States Patent
Sadowara

(10) Patent No.: US 6,351,622 B1
(45) Date of Patent: Feb. 26, 2002

(54) IMAGE FORMING APPARATUS AND IMAGE FORMING METHOD USING AN IMPROVED DRIVE AND CONTROL SYSTEM

(75) Inventor: Tetsuya Sadowara, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/627,422

(22) Filed: Jul. 27, 2000

(51) Int. Cl.[7] ..... G03G 15/00
(52) U.S. Cl. ..... 399/167; 399/36
(58) Field of Search ..... 399/159, 162, 399/167, 303, 388, 394, 396, 36

(56) References Cited

U.S. PATENT DOCUMENTS 4,723,145 A * 2/1988 Takada et al. ..... 399/36
5,819,140 A * 10/1998 Iseki et al. ..... 399/165
6,070,041 A * 5/2000 Nakayasu et al. ..... 399/167 X
6,141,526 A * 10/2000 Ikeda ..... 399/162 X

FOREIGN PATENT DOCUMENTS

JP 6-51551 2/1994
JP 6-263281 9/1994
JP 8-211693 8/1996

* cited by examiner

*Primary Examiner*—Sophia S. Chen
*Assistant Examiner*—Hoan Tran
(74) *Attorney, Agent, or Firm*—Foley & Lardner

(57) ABSTRACT

An image forming apparatus is provided with a photosensitive body drum for supporting an image, an exposing section for exposing a latent image on the photosensitive body drum, a developing device for supplying developing agent to the latent image which has been formed by the exposing section to develop the image, a transferring belt which contacts with the photosensitive body drum to transfer the developing agent image which has been developed by the developing device to a paper, a first driving motor for rotationally driving the photosensitive body drum, a second driving motor for rotationally driving the transferring belt, a first detecting unit for detecting the rotating state of the photosensitive body drum driven by the first driving motor, a second detecting unit for detecting the rotating state of the transferring belt driven by the second driving motor, and a CPU for, when it is determined on the basis of detection signals sent from the first and second detecting units that the rotation of the photosensitive body drum or the transferring belt is stopped or that a difference in rotating speed between the photosensitive body drum and the transferring belt is a predetermined value or more, performing control so as to stop driving of the first and second driving motors.

14 Claims, 5 Drawing Sheets

IMAGE FORMING APPARATUS AND IMAGE FORMING METHOD USING AN IMPROVED DRIVE AND CONTROL SYSTEM

BACKGROUND OF THE INVENTION

The present invention relates to an image forming apparatus which is applied as, for example, an electrophotographic reproducing machine and where a drive and control system of a photosensitive drum and a transferring belt is improved. This Invention also relates to an image forming method using the image forming apparatus.

In an image forming apparatus such as an electrophotographic reproducing machine or the like, there is one where a photosensitive body drum is rotatably provided as an image supporting body or member and a transferring belt serving as transferring means is rotatably provided in opposition to the photosensitive drum. At a time of image formation, a toner image is formed on the photosensitive drum and it is transferred to a paper or sheet fed to the transferring belt according to rotation of a paper or sheet feeding roller. The paper on which an image has been transferred is fed into a fusing or fixing roller pair so that the toner image is fused or fixed on the paper.

The above-mentioned photosensitive drum is rotationally driven by a drum driving motor and the transfer belt is rotationally driven by a belt driving motor. At a time of rotational drive of the drum driving motor and the belt driving motor, FG pulses are input into a CPU for motor control from the drum driving motor and the belt driving motor. Rotational speeds of the photosensitive drum and the transfer belt are controlled by the CPU on the basis of this FG pulse inputting. That is, the rotational speeds of the photosensitive drum and the transfer belt are controlled such that their surfaces become the same constant speed.

The photosensitive drum is connected to the drum driving motor via a power transmission system comprising a drum shaft, a coupling, gears and the like. The transfer belt is spanned between a driving roller and a following or idle roller, and the belt driving motor is connected to the driving roller via a power transmission system comprising a roller shaft, a coupling, gears and the like.

In these circumstances, in a case that a problem regarding driving force transmission occurs in the above-mentioned power transmission system, even when the drum driving motor and the belt driving motor are normally rotated, the photosensitive drum and the transfer belt are not rotated normally in some cases.

In a case that the FG pulses transmitted from the drum driving motor and the belt driving motor are within a predetermined range, the CPU determines that, even when the photosensitive body drum or the transferring belt is not being rotated actually, it is being rotated normally. For this reason, there occurs a case that, for example, in a state where the transferring belt is not being rotated, the photosensitive drum, the sheet feeding roller and the fusing roller continue to rotate. In this case, friction occurs between the transferring belt and the photosensitive body drum, so that the transfer belt or the photosensitive drum is injured or a sheet is jammed in some cases.

Also, even in a case that both the photosensitive drum and the transferring belt are rotated, when a difference in rotating speed therebetween becomes 10% or more, friction occurs between the photosensitive drum and the transfer belt. Accordingly, there is a drawback that the photosensitive drum or the transfer belt may be injured or a sheet may be jammed like the above.

BRIEF SUMMARY OF THE INVENTION

The present invention has been attained in view of the above circumstances, and an object thereof is to provide an image forming apparatus and an image forming method, where rotational drives of first driving means and second driving means are stopped on the basis of stopping of rotation of either one of an image supporting body or member and transferring means or on the basis of a difference equal to a predetermined value or more which occurs between the image supporting body and the transferring means, so that the image supporting body or the transferring means is prevented from being injured due to friction occurring between the image supporting body and the transferring means or conveyance jamming of a member or body on which an image is to be transferred is prevented from occurring.

A first aspect of the present invention comprises: image forming means for forming a latent image on an image supporting body; developing means for supplying developing agent to the latent image which has been formed by the image forming means; transferring means which contacts with the image supporting body to transfer the a developing agent image which has been developed by the developing means to a body on which an image is to be transferred; first driving means for rotationally driving the image supporting body; second driving means for rotationally driving the transferring means; first detecting means for detecting the rotating state of the image supporting body at a driving time of the first driving means; second detecting means for detecting the rotating state of the transferring means at a driving time of the second driving means; and controlling means for, when it is determined on the basis of detection signals sent from the first and second detecting means that one of the image supporting body and the transferring means has been stopped or that a difference in rotating speed between the image supporting body and the transferring means is a predetermined value or more, performing control so as to stop driving of the first and second driving means on the basis of this determination.

An image forming method of the present invention comprises: an image forming step for forming a latent image on an image supporting body; a developing step for developing the latent image which has been formed by the image forming step, by supplying developing agent to the latent image; a transferring step for transferring, by a transfer body contacting with the image supporting body, a developing agent image which has been developed by the developing step to a body on which an image is to be transferred; a driving step for rotationally driving the image supporting body by a first driving means and rotationally driving the transfer body by a second driving means; a detecting step for detecting the rotating states of the image supporting body and the transfer body; and a controlling step for determining whether or not the first and second driving means are normally rotating, when it is determined that they are normally rotating determining whether or not a difference in rotating speed between the image supporting body and the transfer body is a predetermined value or more on the basis of detection information detected in the detecting step, and, when the difference is a predetermined value or more, performing control so as to stop driving of the first and second driving means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be explained below with reference to the drawings.

Figure 1:
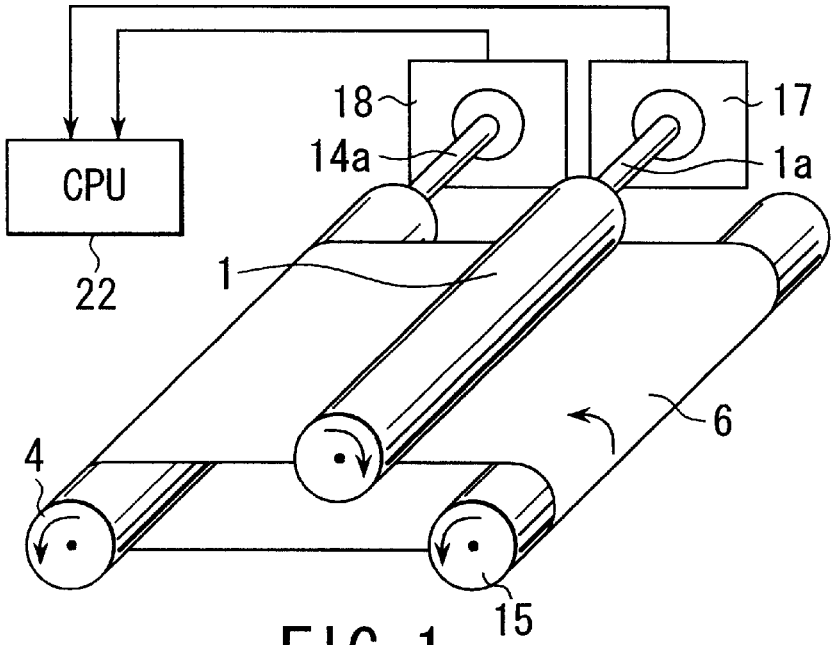
FIG. 1 is a perspective view showing a internal configuration of an electrophotographic reproducing machine according to a first embodiment of the present invention.
Figure 2:
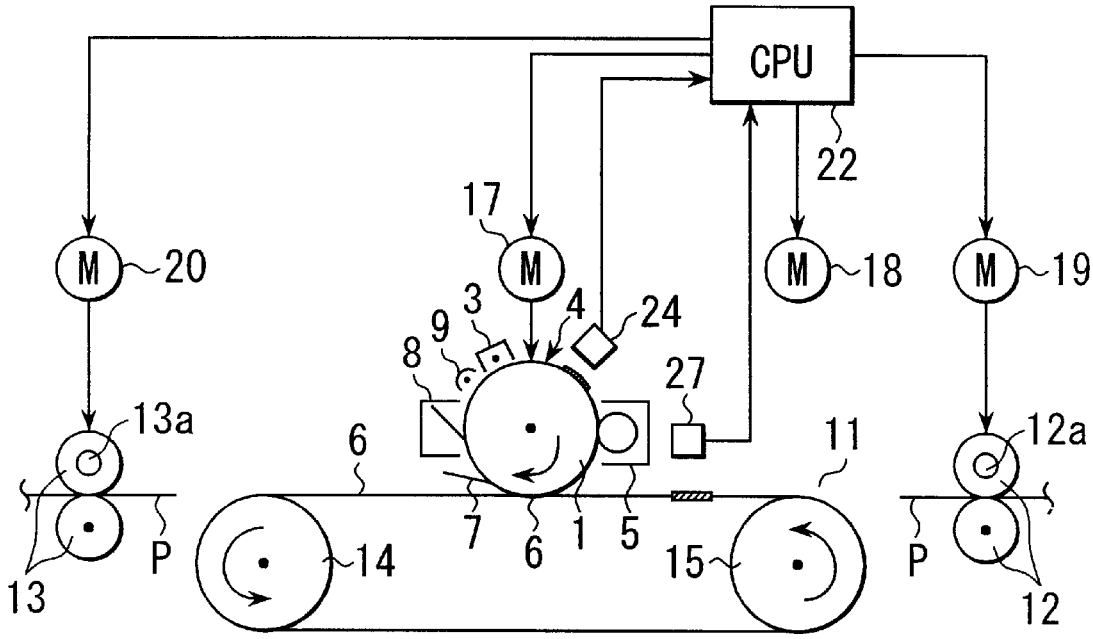
FIG. 2 is a front view showing an internal configuration of the electrophotographic reproducing machine.

FIG. 1 is a perspective view showing an internal configuration of an electrophotographic reproducing machine which is an image forming apparatus, and FIG. 2 is a front view of the internal configuration.

Reference numeral 1 denotes a photosensitive body drum serving as an image supporting body or member, and the photosensitive body drum 1 is rotatably provided in an arrow direction. An electron charger 3, an exposing section 4 serving as latent image forming means, a developing device 5 serving as developing means, a transferring belt 6 serving as transferring means, a peeling-off pawl 7, a cleaning device 8, and a charge removing device 9 are sequentially disposed around the photosensitive body drum 1 along the rotation direction thereof.

The charger 3 charges a surface of the photosensitive body drum 1 to a predetermined potential, and the exposing section 4 forms an electrostatic latent image corresponding to a document image on the photosensitive body drum 1. The transferring belt 6 is spanned between a driving roller 14 and a following or idle roller 15, and it transfers an toner image on the photosensitive body drum 1 to a paper or sheet P serving as a member or body on which transfer is performed. The peeling-off pawl 7 peels off a paper P on which a toner image has been transferred from the photosensitive body drum 1. The cleaning device 8 removes the toner which serves as developing agent and which remains on the photosensitive body drum 1 therefrom, and the charge removing device 9 removes the surface potential remaining on the photosensitive body drum 1 therefrom.

The above-mentioned transferring belt 6 is provided along a conveying path 11 for a paper or sheet, and a paper or sheet feeding roller pair 12 for feeding papers P is provided upstream the transferring belt 6. A fusing or fixing roller pair 13 for fusing or fixing a transferred image on a paper P is provided downstream of the transferring belt 6.

A first driving motor 17 serving as first driving means is connected to a drum shaft la of the above-mentioned photosensitive body drum 1, and a second driving motor 18 serving as second driving means is connected to a shaft 14*a* of the driving roller 14 for the transferring belt 6. Also, a third driving motor 19 is connected to a shaft 12*a* of the paper feeding roller pair 12, and a fourth driving motor 20 is connected to a shaft 13*a* of the fusing roller pair 13. The first to fourth driving motors 17 to 20 are connected to a CPU 22 serving as control means via a control circuit.

FG pulses generated from the first and second driving motors 17, 18 are input in the CPU 22 at a time of rotational drive of the first and second driving motors 17 and 18, and whether or not rotating states of the first and second driving motors 17 and 18 are normal is determined on the basis of this input by the CPU 22.

Figure 3:
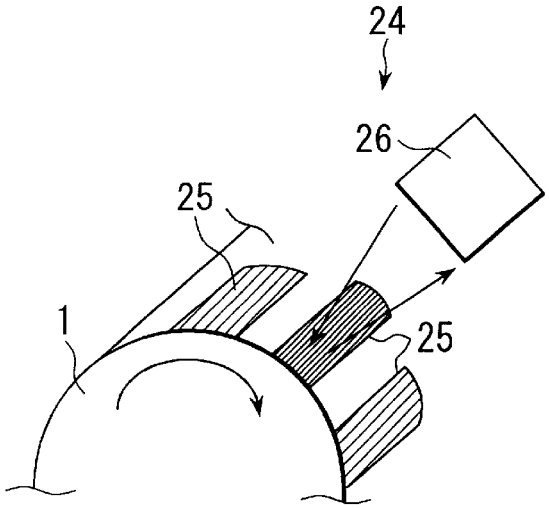
FIG. 3 is a perspective view showing a first detecting unit for detecting rotation of a photosensitive drum.

FIG. 3 shows a first detecting unit 24 serving as first detecting means for detecting the rotating speed of the photosensitive body drum 1. The first detecting unit 24 comprises reflecting portions 25 disposed at predetermined intervals on surface one side portions of the photosensitive body drum 1 along the rotating direction thereof and an optical sensor 26 for irradiating light on these reflecting portions 25 and receiving light reflected from the reflecting portions 25. The optical sensor 26 is connected to the CPU 22 via a signal path.

Figure 4:
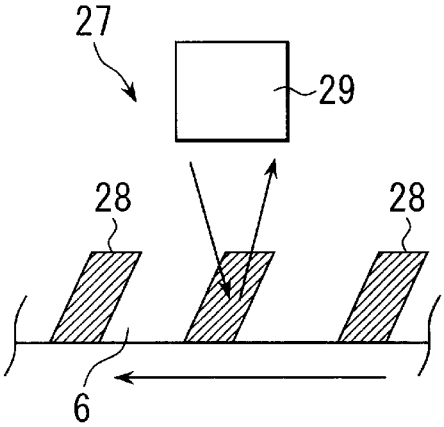
FIG. 4 is a perspective view showing a second detecting unit for detecting rotation of a transferring belt.

FIG. 4 shows a second detecting unit 27 serving as second detecting means for detecting the rotating speed of the transferring belt 6. The second detecting unit 27 comprises reflecting portions 28 disposed at predetermined intervals on surface one side portions of the transferring belt 6 along the rotating direction thereof and an optical sensor 29 for irradiating light on these reflecting portions 28 and receiving light reflected from the reflecting portions 28. The optical sensor 29 is connected to the CPU 22 via a signal path.

Figure 5:
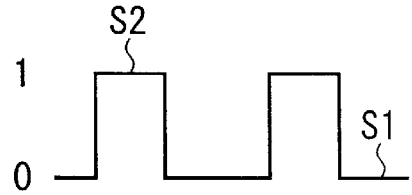
FIG. 5 is a graph showing a detection signal transmitted from the first and the second detecting units at a time of rotation of the photosensitive body drum and the transferring belt.

FIG. 5 shows detection signals output from each of the optical sensors 26 and 29 of the first and second detecting units 24 and 27 at a time of rotation of each of the photosensitive body drum 1 and the transferring belt 6, and the detection signals are transmitted to the CPU 22 via a signal path. When each of the optical sensors 26 and 29 receives light, it outputs the detection signal S1, and when it does not receive light, it outputs the detection signal S2.

Figure 6:
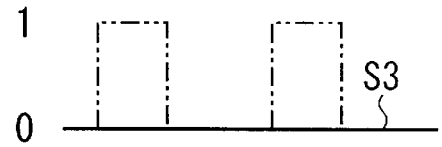
FIG. 6 is a graph showing a detection signal transmitted from the first and the second detecting units at a time of rotation stop of the photosensitive body drum and the transferring belt.
Figure 7:
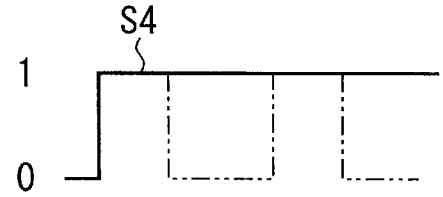
FIG. 7 is a graph showing a detection signal transmitted from the first and the second detecting units at a time of rotation stop of the photosensitive body drum and the transferring belt.

FIG. 6 and FIG. 7 show detection signals output from the optical sensors 26 and 27 at a time of rotation stop of the photosensitive body drum 1 and the transferring belt 6, and these detection signals are transmitted to the CPU 22 via a signal path. When each of the optical sensors 26 and 29 receives light, it outputs the detection signal S3 and when it does not receive light, it outputs the detection signal S4

When the CPU 22 receive one of the detection signals S3 and S4 shown in FIG. 6, FIG. 7, the first to fourth driving motors 17 to 20 are stopped.

Also, even in a case that the CPU 22 receives the detection signal at a time of rotation of the photosensitive body drum 1 and the transferring belt 6, when a difference in rotational speed between the photosensitive drum 1 and the transferring belt 6 is made equal to a predetermined value or more, for example, 10% or more, the first to fourth driving motors 17 to 20 are stopped.

Next, an image forming operation will be explained.

At a time of image forming, the photosensitive body drum 1 is rotated by the first driving motor 17 and the transferring belt 6 is rotated by the second driving motor 18. The surface of the photosensitive drum 1 is charged uniformly by the electron charger 3, and an electrostatic latent image is formed on the charged surface of the photosensitive body drum 1 by exposure performed by the exposing section 4. The electrostatic latent image is sent to the developing device 5 according to rotation of the photosensitive body drum 1, and toner serving as developing agent is supplied from the developing device 5 so that the electrostatic latent image is developed to a toner image.

On the other hand, at this time, the paper feeding roller pair 12 is rotated by the third driving motor 19, and the fusing roller pair 13 by the fourth driving motor 12. A paper P is fed according to rotation of the paper feeding roller pair 12, and the paper P is sent according to rotation of the transferring belt 6 to an image forming and transforming section 6*a*, where a toner image which has been formed on the photosensitive body drum 1 is transferred to the paper P. The paper P with the toner image transferred is peeled off from the photosensitive body drum 1 by the peeling-off pawl 7 and conveyed. The paper P is fed to the fusing roller pair 13, where it is subjected to heating and pressurizing, so that the toner image is fused or fixed on the paper P.

After the above-mentioned transferring of the toner image onto the paper P, toner remaining on the photosensitive body drum 1 is removed by the cleaning device 8. After the remaining toner is removed by the cleaning device 8, the surface of the photosensitive body drum 1 is charge-eliminated by the charge eliminating charger or device 9 so that the image forming apparatus can be prepared for the next image forming process.

In this image forming process, a problem regarding power transmission occurs in the driving force transmission systems which connect the shaft 14*a* of the driving roller 14 of the transferring belt 6 and the drum shaft 1*a* of the photosensitive body drum 1 with the first and second driving motors 18 and 19, respectively, in some cases. In these cases, there occurs a case that, even when the first and second driving motors 17 and 18 are rotated normally, the transferring belt 6 or the photosensitive body drum 1 is not rotated. However, when FG pulses transmitted from the first and second driving motors 17 and 18 to the CPU 22 are within a predetermined range, the CPU erroneously determines that the transferring belt 6 and the photosensitive body drum 1 are rotating normally.

For this reason, for example, there occurs a case that the photosensitive body drum 1, the paper feeding roller pair 12 and the fusing roller pair 13 continue to be rotated in a state where rotation of the transferring belt 6 is not stopped. Due to the continuation of the rotations, there may occur a friction between the transferring belt 6 and the photosensitive body drum 1, thereby injuring the transferring belt 6 or the photosensitive body drum 1 or causing jamming of a paper P.

In the present invention, therefore, the first and the second detecting units 24 and 27 are provided and presence/absence of rotation (rotation/non-rotation) of the photosensitive body drum 1 or the transferring belt 6 is detected by the first and the second detecting units 24 and 27 so that the driving of the first to fourth driving motors 17 to 20 is controlled on the basis of this detection. Thus, the above problem is prevented from occurring in this manner.

Figure 8:
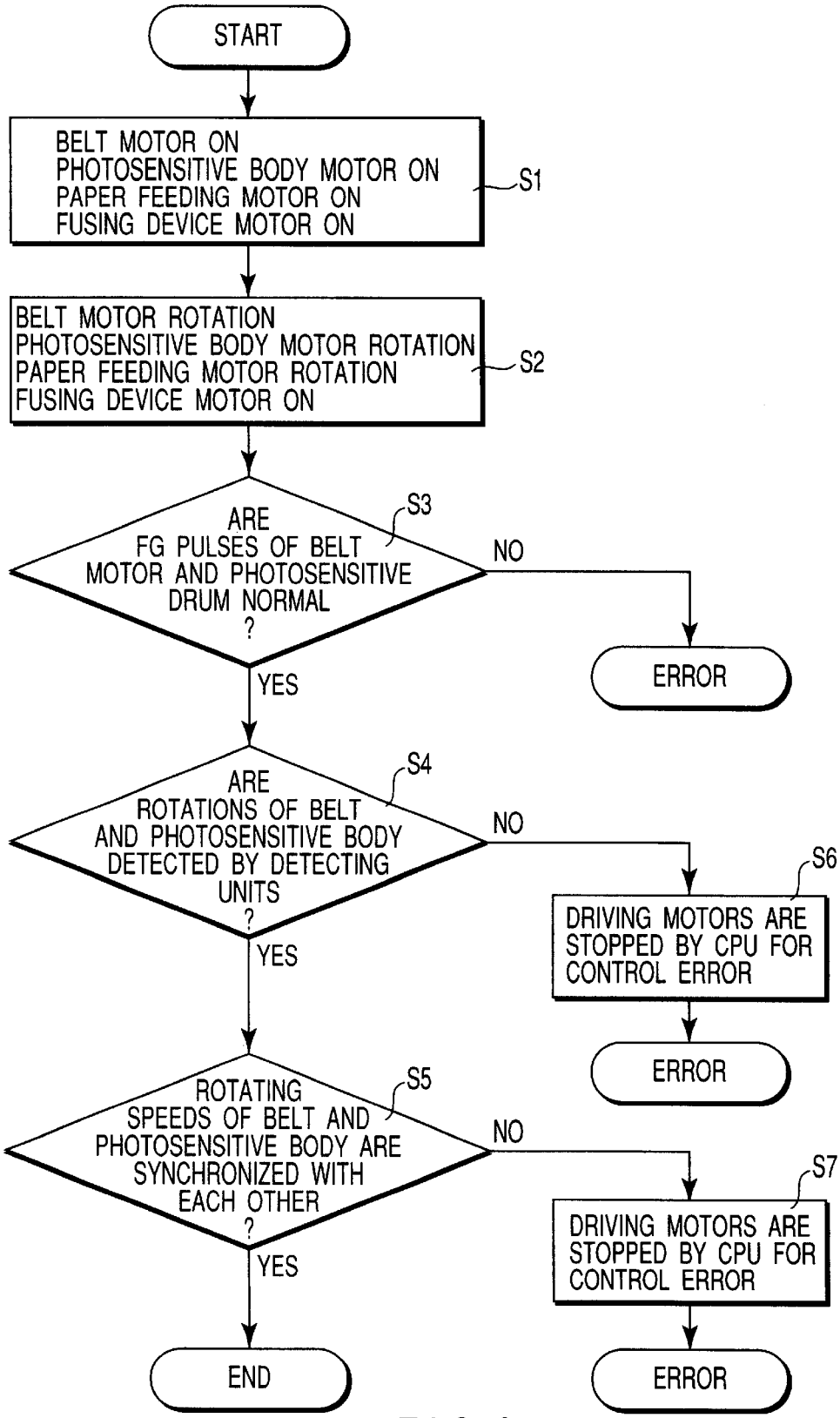
FIG. 8 is a flowchart showing control operation of a driving motor.

Drive control of the driving motors 17 to 20 will be explained with reference to a flowchart in FIG. 8.

When the first to fourth driving motors 17 to 20 are driven (Step S1), the photosensitive body drum 1, the transferring belt 6, the paper feeding roller pairs 12, and the fusing roller pair 13 are rotated (Step S2). Then, FC pulses are transmitted from the first and second driving motors 17 and 18 to the CPU 22, and whether or not the FC pulses are normal is determined by the CPU 22 (Step S3). When it is determined by the CPU that the FC pulses are normal, the rotating states of the photosensitive body drum 1 and the transferring belt 6 are detected by the first and second units 24 and 27 (Step S4). In a case that it is determined by the CPU 22 that the photosensitive body drum 1 and the transferring belt 6 are rotated normally, whether or not they are being rotated in synchronism with each other is determined (Step S5). When it is determined by the CPU 22 that the drum 1 and the belt 6 are being rotated in synchronism with each other, the rotations of the first to fourth driving motors 17 to 20 are continued as they are.

In the above-mentioned Step S3, however, when it is determined by the CPU 22 that the FC pulses are not normal, an error signal is generated by the CPU 22. Also, in Step S4, when it is determined by the CPU 22 that the photosensitive body drum 1 and the transferring belt 6 are not rotating, the rotations of the first to fourth driving motors 17 to 20 are stopped by the CPU 22 (Step S6). Also, in Step S5, when it is determined by the CPU 22 that the photosensitive body drum 1 and transferring belt 6 are not synchronized with each other and a difference in rotating speed therebetween is a predetermined value or more, the rotations of the first to fourth driving motors 17 to 20 are stopped (Step S7).

As mentioned above, in a time of rotational driving of the first to fourth driving motors 17 to 20, when the photosensitive body drum 1 and the transferring belt 6 are not rotated or when the difference in rotating speed therebetween becomes the predetermined value or more, the rotations of the first to fourth driving motors 17 to 20 are stopped. Accordingly, friction does not occur between the photosensitive body drum 1 and the transferring belt 6 so that the photosensitive body drum 1 and/or the transferring belt 6 is prevented from being injured, and conveyance jamming of a paper is also prevented from occurring because the conveyance of a paper P is stopped.

Figure 9:
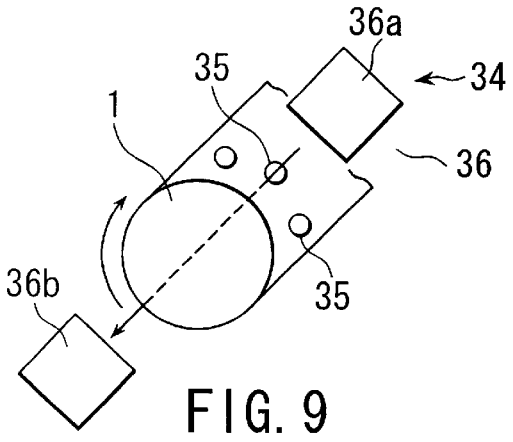
FIG. 9 is a diagram showing a first modification of the first detecting unit.

FIG. 9 shows a first modification of the first detecting unit. In this first modification, a first detecting unit 34 comprises through holes 35 formed on one side portion of the photosensitive body drum 1 and a transmission type optical sensor 36. The transmission type optical sensor 36 comprises a light emitting element 36*a* for emitting light to the through hole 35 and a light receiving element 36*b* for receiving light which has passed through the through hole 35.

In this first modification, when light emitted from the light emitting element 36*a* continues to be received by the light receiving element 36*b* or when the light receiving element 36*b* is maintained in a continuously non-receiving state of light emitted from the light emitting element 36*a*, it is determined by the CPU 22 that the transferring belt 6 is in a stopped state.

Also, in the first modification, the rotating speed of the photosensitive body drum 1 is calculated by the CPU 22 on the basis of how many times the light receiving element 36*b* receives light within a predetermined time.

Figure 10:
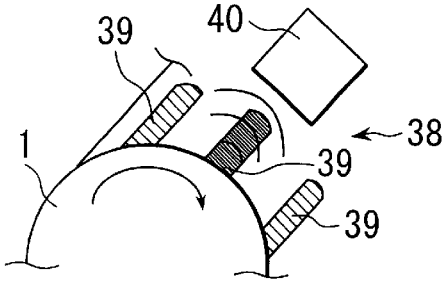
FIG. 10 is a view showing a second modification of the first detecting unit.

FIG. 10 shows a second modification of the first detecting unit. In the second modification, a first detecting unit 38 comprises magnetic marks formed on one side portion of the photosensitive body drum 1 along the rotation direction thereof at predetermined intervals and a magnetic sensor 40 for detecting magnetism of the magnetic marks 39.

In the second modification, when the magnetic sensor 40 continues to detect magnetism of the magnetic mark 39 or when it is maintained in a continuously non-detecting state of magnetism, it is determined by the CPU 22 that the transferring belt 6 is in a stopping state.

Also, in this second modification, the rotating speed of the photosensitive body drum 1 is calculated by the CPU 22 on the basis of how many times the magnetic sensor 40 detects magnetism of the magnetic marks 39 within a predetermined time.

Figure 11:
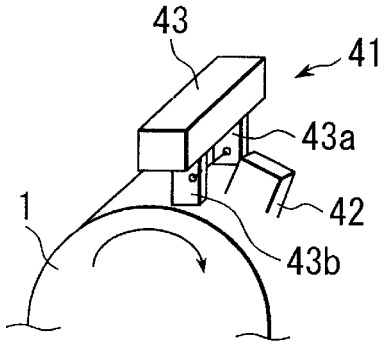
FIG. 11 is a view showing a third modification of the first detecting unit.

FIG. 11 shows a third modification of the first detecting unit. In the third modification, a first detecting unit 41 comprises projecting portions 42 provided on one side portion of the photosensitive drum 1 along the rotation direction thereof at predetermined intervals and a transmission type optical sensor 43. The transmission type optical sensor 43 comprises a light emitting element 43*a* for emitting light to the projecting portions 42 and a light receiving element 43*b* for receiving light emitted from the light emitting element 43*a*.

In the third modification, when light emitted from the light emitting element 43*a* continues to be received by the light receiving element 43*b* or when the light receiving element 43*b* is maintained in a continuously non-receiving state of light emitted from the light emitting element 43*a*, it is determined by the CPU 22 that the photosensitive body drum 1 is in a stopped state.

Also, in the third modification, the rotating speed of the photosensitive body drum 1 is calculated by the CPU 22 on the basis of how many times the light receiving element 43*b* receives light within a predetermined time.

Figure 12:
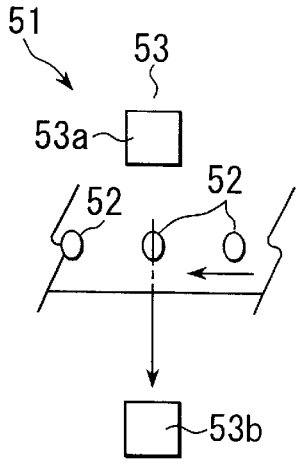
FIG. 12 is a view showing a first modification of the second detecting unit.

FIG. 12 shows a first modification of the second detecting unit. In the first modification, a second detecting unit 51 comprises through holes 52 formed on one side portion of the transferring belt 6 along rotation of the transferring belt 6 and a transmission type optical sensor 53. The transmission type optical sensor 53 comprises a light emitting element 53*a* for emitting light to the through hole 52 and a light receiving element 53*b* for receiving light which has passed through the through hole 52.

In this first modification, when light emitted from the light emitting element 53*a* continues to be received by the light receiving element 53*b*, or when the light receiving element 53*b* is maintained in a non-receiving state of light emitted from the light emitting element 53*a*, it is determined by the CPU 22 that the transferring belt 6 is in a stopped state.

Also, in the first modification, the rotating speed of the photosensitive body drum 1 is calculated by the CPU 22 on the basis of how many times the light receiving element 53*b* receives light within a predetermined time.

Figure 13:
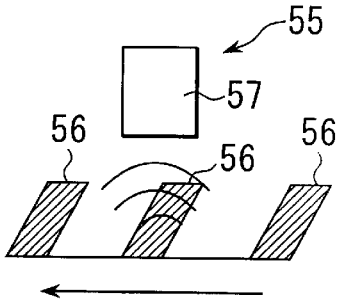
FIG. 13 is a view showing a second modification of the second detecting unit.

FIG. 13 shows a second modification of the second detecting unit. In the second modification, a second detecting unit 55 comprises magnetic marks 56 formed on one side portion of the photosensitive body drum 1 along the rotation direction thereof at predetermined intervals and a magnetic sensor 57 for detecting magnetism of the magnetic marks 56.

In the second modification, when the magnetic sensor 57 continues to detect magnetism of the magnetic mark 56 or when it is maintained in a continuously non-detecting state thereof, it is determined by the CPU 22 that the transferring belt 6 is in a stopping state.

Also, in this second modification, the rotating speed of the transferring belt 6 is calculated by the CPU 22 on the basis of how many times the magnetic sensor 57 detects magnetism of the magnetic marks 56 within a predetermined time.

Figure 14:
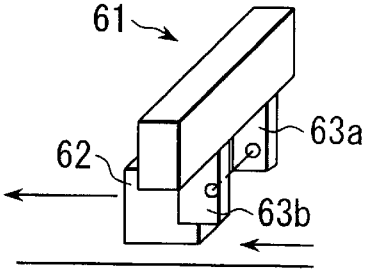
FIG. 14 is a view showing a third modification of the second detecting unit.

FIG. 14 shows a third modification of the second detecting unit. In the third modification, a second detecting unit 61 comprises projecting portions 62 provided on one side portion of the photosensitive body drum 1 along the rotation direction thereof at predetermined intervals and a transmission type optical sensor 63. The transmission type optical sensor 63 comprises a light emitting element 43*a* for emitting light to the projecting portions 62 and a light receiving element 63*b* for receiving light emitted from the light emitting element 63*a*.

In the third modification, when light emitted from the light emitting element 63*a* continues to be received by the light receiving element 63*b* or when the light receiving element 63*b* is maintained in a continuously non-receiving state of light emitted from the light emitting element 63*a*, it is determined by the CPU 22 that the transferring belt 6 is in a stopped state.

Also, in the third modification, the rotating speed of the transferring belt 6 is calculated by the CPU 22 on the basis of how many times the light receiving element 63*b* receives light within a predetermined time.

Figure 15:
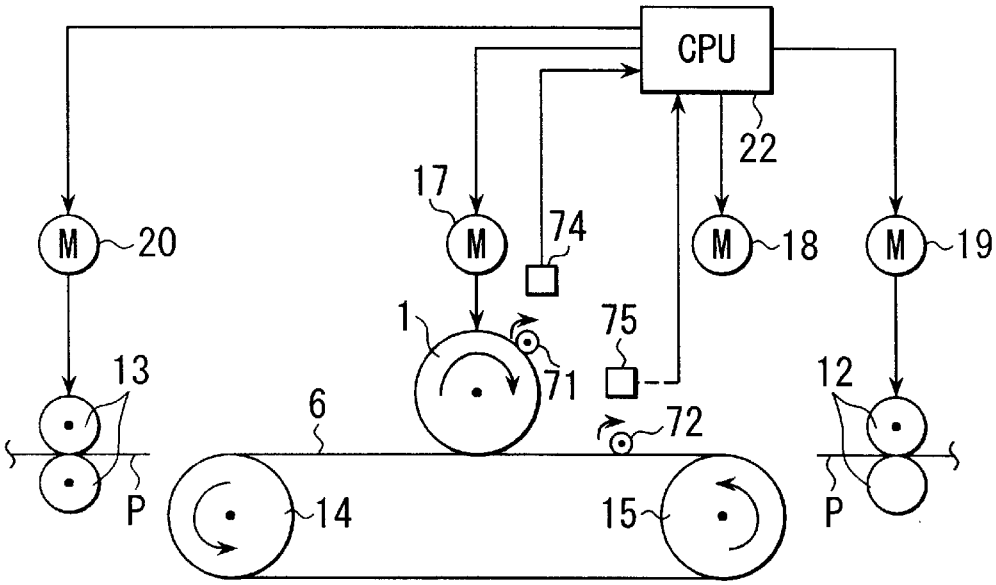
FIG. 15 is a perspective view showing a internal configuration of an electrophotographic reproducing machine according to a second embodiment of the present invention.

FIG. 15 shows a second embodiment of the present invention. The second embodiment is applied when the above reflecting portions, through holes, magnetic marks, projecting portions or the like can not be formed directly in the surface of the photosensitive drum 1 and the surface of the transferring belt 6 unlike the first embodiment.

Incidentally, portions and members of the second embodiment corresponding to those of the first embodiment are attached with the same reference numerals as the latter, and explanation thereof will be omitted.

In this second embodiment, a first following or idle roller 71 which serves as a first member to be detected and which contacts with one side portion surface of the photosensitive body drum 1 to rotate according to rotation of the photosensitive body drum 1 is provided in the vicinity of the photosensitive body drum 1. A second following or idle roller 72 which contacts with one side portion surface of the transferring belt 6 to rotate according to rotation of the transferring belt 6 is provided in the vicinity of the transferring belt 6. The reflecting portions, through holes, magnetic marks, projecting portions or the like as shown in the above-mentioned first embodiment are formed on these first and second following rollers 71 and 72 to configure first and second detecting units 74 and 75, so that the rotating states of the photosensitive drum 1 and the transferring belt 6 are detected.

Figure 16:
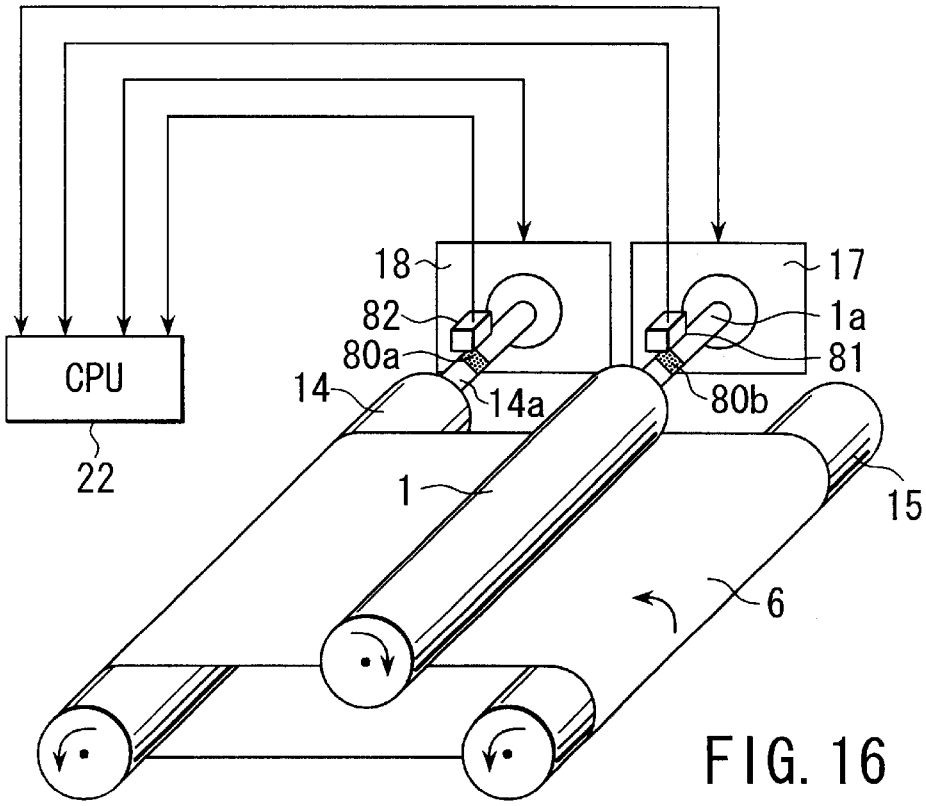
FIG. 16 is a perspective view showing a internal configuration of an electrophotographic reproducing machine according to a third embodiment of the present invention.

FIG. 16 shows a third embodiment of the present invention.

This third embodiment is applied when it is difficult to provide the first and second following rollers 71 and 72 shown in the above-mentioned second embodiment.

That is, in the third embodiment, first and second detecting units 81 and 82 are configured by forming the reflecting portions, through holes, magnetic masks, projecting portions 80*a* and 80*b*, or the like on the driving shaft 14*a* of the transferring belt 6 and the shaft 1*a* of the photosensitive drum 1 in the same manner as the above embodiments, so that the rotating states of the photosensitive body drum 1 and the transferring belt 6 are detected.

Incidentally, when it is difficult to provide detecting units for detecting the rotating states of the photosensitive body drum 1 and the transferring belt 6 on the photosensitive body drum 1 and the transferring belt 6 independently from each other, a detecting unit may be provided on only one of the photosensitive body drum 1 and the transferring belt 6 in order to detect the rotating state of the one.

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. An image forming apparatus, comprising:

image forming means for forming a latent image on an image supporting body;

developing means for supplying developing agent to the latent image which has been formed by the image forming means;

transferring means which contacts with the image supporting body to transfer a developing agent image which has been developed by the developing means to a body on which an image is to be transferred;

feeding means for feeding the body between the transferring means and the image supporting body;

first driving means for rotationally driving the image supporting body;

second driving means for rotationally driving the transferring means;

third driving means for rotationally driving the feeding means;

first detecting means for detecting the rotating state of the image supporting body;

second detecting means for detecting the rotating state of the transferring means;

controlling means for determining rotating states of the first and second driving means, and performing control so as stop drive of the first to third driving means when it is detected that rotation of one of the image supporting body and the transferring means is stopped, or it is detected that a difference in rotating speed between the image supporting body and the transferring means is equal to or more than a predetermined value.

2. An image forming apparatus according to claim 1, wherein the first detecting means comprises a reflecting portion provided on the image supporting body and a light receiving sensor for emitting light to the reflecting portion and receiving light reflected from the reflecting portion.

3. An image forming apparatus according to claim 1, wherein the first detecting means comprises a through hole formed in the image supporting body, a light emitting element for emitting light to the through hole, and a light receiving sensor for receiving light passing through the through hole.

4. An image forming apparatus according to claim 1, wherein the first detecting means comprises a magnetic mark provided on the image supporting body and a magnetic sensor for detecting magnetism generated from the magnetic mark.

5. An image forming apparatus according to claim 1, wherein the first detecting means comprises a projecting portion provided on the image supporting body, a light emitting element for emitting light to the projecting portion, and a light receiving sensor for receiving light which is not obstructed by the projecting portion.

6. An image forming apparatus according to claim 1, wherein the second detecting means comprises a reflecting portion provided on the transferring means and a light receiving sensor for emitting light to the reflecting portion and receiving light reflected from the reflecting portion.

7. An image forming apparatus according to claim 1, wherein the second detecting means comprises a through hole formed in the transferring means, a light emitting element for emitting light to the through hole, and a light receiving sensor for receiving light passing through the through hole.

8. An image forming apparatus according to claim 1, wherein the second detecting means comprises a magnetic mark provided on the transferring means and a magnetic sensor for detecting magnetism generated from the magnetic mark.

9. An image forming apparatus according to claim 1, wherein the second detecting means comprises a projecting portion provided on the transferring means, a light emitting element for emitting light to the projecting portion, and a light receiving sensor for receiving light which is not obstructed by the projecting portion.

10. An image forming apparatus according to claim 1, wherein the first detecting means comprises a first object to be detected, which rotates in accordance with rotation of the image supporting body, and detects the rotating state of the image supporting body by detecting a rotating state of the first object to be detected, and the second detecting means comprises a second object to be detected, which rotates in accordance with rotation of the transferring means, and detects the rotating state of the transferring means by detecting a rotation state of the second object to be detected.

11. An image forming method comprising:

an image forming step for forming a latent image on an image supporting body;

a developing step for developing the latent image which has been formed by the image forming step, by supplying developing agent to the latent image;

a transferring step for transferring, by a transferring body contacting with the image supporting body, a developing agent image which has been developed by the developing step to a body on which an image is to be transferred;

a feeding step for feeding the body between the transferring body and the image supporting body by using a feeding body;

a driving step for rotationally driving the image supporting body by a first driving means and rotationally driving the transferring body by a second driving means, and rotationally driving the feeding body by using a third driving means;

a detecting step for detecting the rotating states of the image supporting body and the transferring body; and a controlling step for determining rotating states of the first and second driving means, and performing control so as to stop driving of the first to third driving means, when it is detected that rotation of one of the image supporting body and the transferring body is stopped, or it is detected that a difference in rotating speed between the image supporting body and the transferring body is equal to or more than a predetermined value.

12. An image forming method according to claim 11, wherein in the controlling step it is determined whether or not the first and second driving means are normally rotating, on the basis of pulses sent from the first and second driving means.

13. An image forming method according to claim 11, wherein in the detection step the rotation states of the image supporting body and the transfer body are optically or magnetically detected.

14. An image forming apparatus, comprising:

an image former for forming a latent image on an image supporting body;

a developer for supplying developing agent to the latent image which has been formed by the image former;

a transferer which contacts with the image supporting body to transfer a developing agent image which has been developed by the developer to a body on which an image is to be transferred;

a feeder for feeding the body between the transferer and the image supporting body;

a first driver for rotationally driving the image supporting body;

a second driver for rotationally driving the transferer;

a third driver for rotationally driving the feeder;

a first detector for detecting the rotating state of the image supporting body;

a second detector for detecting the rotating state of the transferer;

a controller for determining rotating states of the first and second drivers, and performing control so as to stop drive of the first to third drivers when it is detected that rotation of one of the image supporting body and the transferer is stopped, or it is detected that a difference in rotating speed between the image supporting body and the transferer is equal to or more than a predetermined value.

* * * * *